US009573179B2

(12) United States Patent
Muffatto

(10) Patent No.: US 9,573,179 B2
(45) Date of Patent: Feb. 21, 2017

(54) DEVICE AND METHOD FOR MANUFACTURING A METAL WHEEL

(71) Applicant: RONAL AG, Härkingen (CH)

(72) Inventor: Giorgio Muffatto, Mirano (IT)

(73) Assignee: RONAL AG, Härkingen (CH)

( * ) Notice: Subject to any disclaimer, the term of this patent is extended or adjusted under 35 U.S.C. 154(b) by 5 days.

(21) Appl. No.: 14/354,245

(22) PCT Filed: Oct. 24, 2012

(86) PCT No.: PCT/EP2012/004444
§ 371 (c)(1),
(2) Date: Apr. 25, 2014

(87) PCT Pub. No.: WO2013/060451
PCT Pub. Date: May 2, 2013

(65) Prior Publication Data

US 2014/0283572 A1 Sep. 25, 2014

(30) Foreign Application Priority Data

Oct. 27, 2011 (DE) ..... 10 2011 117 034

(51) Int. Cl.
*B21D 22/00* (2006.01)
*B21B 41/00* (2006.01)
(Continued)

(52) U.S. Cl.
CPC ..... *B21B 41/00* (2013.01); *B21D 5/002* (2013.01); *B21D 5/004* (2013.01); *B21D 5/04* (2013.01);
(Continued)

(58) Field of Classification Search
CPC ..... B21D 22/16; B21D 22/18; B21D 53/30; B21D 22/14
See application file for complete search history.

(56) References Cited

U.S. PATENT DOCUMENTS 3,282,078 A 11/1966 Kaesemeyer
3,779,060 A 12/1973 Schroder
(Continued)

FOREIGN PATENT DOCUMENTS

DE 14 52 610 A 3/1969
DE 20 53 005 A1 5/1972
(Continued)

OTHER PUBLICATIONS

European Office Action of Jan. 12, 2016.

*Primary Examiner* — Debra Sullivan
(74) *Attorney, Agent, or Firm* — McGlew and Tuttle, P.C.

(57) ABSTRACT

A device for manufacturing a metal wheel (1) from a pre-form, with stretching rolls (3) engaging on the rim region of the pre-form, by means of which rolls a rim (1.1) is end-formed which, for forming a rim flange (1.7). Freely rotatable rolls (4) are arranged underneath the stretching rolls (3) and cooperate with them. A method for manufacturing a metal wheel (1) from a pre-form, the pre-form of the metal wheel (1) to be manufactured is placed on a clamping mandrel (2) and is caused to rotate, stretching rolls (3) engage an axially outer side of a rotation-symmetrical jacket of the pre-form with the exertion of radial pressure, and move along the jacket wall of the pre-form with compression and stretching of the jacket wall to form a rim (1.1) with a main movement component parallel with the axis of rotation (2.1) of the pre-form.

20 Claims, 4 Drawing Sheets

(51) Int. Cl.

| | |
|---|---|
| ***B21D 22/16*** | (2006.01) |
| ***B21D 22/14*** | (2006.01) |
| ***B21D 53/30*** | (2006.01) |
| ***B21D 5/00*** | (2006.01) |
| ***B21D 5/04*** | (2006.01) |

(52) U.S. Cl.
CPC ..... *B21D 22/14* (2013.01); *B21D 22/16* (2013.01); *B21D 53/30* (2013.01)

(56) References Cited

U.S. PATENT DOCUMENTS

| | | | | | |
|---|---|---|---|---|---|
| 3,846,886 | A | | 11/1974 | Schroder et al. | |
| 5,454,248 | A | * | 10/1995 | Inatani | B21D 53/30 29/894.324 |
| 5,531,024 | A | * | 7/1996 | Lowe | B21D 53/30 29/894.323 |
| 2001/0054822 | A1 | * | 12/2001 | Pakker | B21D 19/046 285/424 |
| 2003/0145466 | A1 | | 8/2003 | Baek | |
| 2008/0252136 | A1 | * | 10/2008 | Srivats | B21D 53/264 301/63.109 |

FOREIGN PATENT DOCUMENTS

| | | | |
|---|---|---|---|
| DE | 22 31 842 | A1 | 1/1974 |
| DE | 103 22 752 | A1 | 12/2004 |
| EP | 1 712 310 | A1 | 10/2006 |
| EP | 1 714 714 | A1 | 10/2006 |
| EP | 1 712 310 | B1 | 7/2007 |
| JP | 52 063164 | A | 5/1977 |
| WO | 2005/065049 | A2 | 7/2005 |

* cited by examiner

DEVICE AND METHOD FOR MANUFACTURING A METAL WHEEL

CROSS REFERENCE TO RELATED APPLICATIONS

This application is a U.S. National Phase Application of International Application PCT/EP2012/004444 filed Oct. 24, 2012 and claims the benefit of priority under 35 U.S.C. §119 of German Patent Application DE 10 2011 117 034.4 filed Oct. 27, 2011, the entire contents of which are incorporated herein by reference.

FIELD OF THE INVENTION

The invention relates to a device for manufacturing a light-metal wheel from a pre-form with stretching rolls engaging on the rim region of the pre-form, by means of which rolls a rim of the wheel is end-formed. The invention also relates to a method for manufacturing a metal wheel from a pre-form, wherein the pre-form of the metal wheel to be manufactured is placed on a clamping mandrel and caused to rotate, stretching rolls engage an axially outer side of a rotation-symmetrical jacket of the pre-form with the exertion of radial pressure, and move along the jacket wall of the pre-form with compression and stretching of the jacket wall to form a rim with a main movement component parallel with the axis of rotation of the pre-form.

The invention relates in particular to the manufacture of light metal wheels light-alloy wheels particularly made of aluminum or aluminum alloy by means of flow forming. This a sub-form of shear forming, whilst in German different terms, such as flow pressure rolling, rotary rolling or stretch rolling are used and the latter term is to be used here. Stretch rolling is a non-cutting forming process for end-forming rotating bodies of light metal such as aluminum or aluminum alloys, particularly metal wheels.

BACKGROUND OF THE INVENTION

In this case the pre-form of a wheel with a rotation-symmetrical jacket configuration is placed on a simple rotating tool, a clamping mandrel, which is caused to rotate with the pre-form. On the peripheral edge a plurality of differently shaped stretching rolls engage with radial pressure on the rotation-symmetrical peripheral wall of the pre-form and are moved along this, i.e. in an axial component during the rotation of the pre-form, which on the one hand compresses the material and on the other stretches this material by means of the stretching rolls moving essentially in the axial direction, thereby deforming it to form the rim when a metal wheel is manufactured. On the lower peripheral edge the generally inner rim flange of the wheel to be formed is formed on a recess of the rotary mandrel. This machining process, which is actually a cold forming process, may be carried out an elevated temperature of up to 350° C., but it must be borne in mind here that heating takes place in any case simply because the deformation process takes place by means of the stretching rolls. Such processes are in principle disclosed in US 2003/0145466 A1 or ITVI20040061 A.

One disadvantage is the fact that the inner or lower side of the wheel to be produced is predetermined by the shape of the stretching mandrel and that the peripheral edge of the rim flange can only be end-formed at high cost by lowering the same with the stretching rolls, for which purpose complicated processes are required for controlling the movement on the one hand, and the clamping mandrel may cause interference on the other.

SUMMARY OF THE INVENTION

The objective of the invention is therefore to develop a suitable device for manufacturing metal wheels to the extent that the inner rim flange in particular can be formed more quickly and less expensively.

To achieve this objective a device according to the invention is characterized by freely rotatable rolls arranged underneath the stretching rolls and cooperating with them. A method according to the invention is characterized, for achieving the objective, in that the pre-form is gripped from below by freely rotating rolls which are arranged at the same circumferential angles as the stretching rolls around the periphery of the pre-form so that the stretching rolls form a rim flange by stretching pre-form material against the freely rotating rolls gripping from below.

The inventive device has an inner mandrel receiving the pre-form of a wheel and stretching rolls, which engage initially in the outer region of a rotation-symmetric circumferential wall of the pre-form (the outer region of the pre-form placed for working to the top). The stretching rolls are movable along the circumferential wall of the pre-form as well exerting radial force and compressing it-radially-as-axially-stretching the circumferential wall. Accordingly the stretching rolls finish or endform the rim of the wheel along the mandrel.

The clamping mandrel inside the pre-form of the wheel or inside the wheel which is to be produced is a body with rotational symmetry which does not have any undercuts in the jacket area; ideally, the clamping mandrel is slightly conical from the outside to the inside of the wheel.

The clamping mandrel must not, as would be the case of undercuts, be a body consisting of several party, whose individual parts would have to be retracted by means of additional hydraulic gripping elements, which would make such a tool design vulnerable and would also impair the precision of the wheel with regard to roundness and could cause imbalance. The clamping mandrel protrudes up to the height of the inner rim flange into the wheel which is to be produced; however it does not grip the wheel from below.

The device according to the invention is designed so that at least one of the stretching rolls which engage with the side of the wheel cause the (flow)forming of the jacket of the wheel over its entire height, including the formation of the outside of the inner rim flange.

The forming may be performed as hot or cold forming. In the first case working is done with hot tools and, hot pre-form, in the second case with cold tools and cold pre-form, but which warms up by of the working process to a certain degree. Hot forming is preferably used for cast pre-forms, cold forming for forged pre-forms.

A device according to the invention may also be characterized, in its design, in that the freely rotating rolls have an axis of rotation inclined at an angle of inclination of 50° to 70° to an axis of rotation of the pre-form, wherein, in particular, the angle of inclination of the axes of rotation of the freely rotating rolls is adjustable to the axis of rotation of the pre-form.

Further designs of the device according to the invention provide that the freely rotating rolls grip the rim flange to be formed from underneath with their jacket wall, wherein, in particular, the freely rotating rolls are in the shape of a truncated cone and/or the jacket wall of the freely rotating rolls enclose an angle of between 20° and 40° to the axis of rotation of the freely rotating rolls. A profile stretching roll end-forming a rim flange may also be provided.

The method according to the invention provides, in a further development, that the freely rotating rolls rotate about axes which enclose the angle of inclination of 50° to 70° to the axis of rotation of the pre-form, wherein, in particular, the freely rotating rolls grip the lower edge of the pre-form from below with their jacket, which encloses an angle of 20° to 40° to the axis of rotation of the freely rotating rolls. Provision may also be made, in particular, at least one profile stretching roll to engage against the rim flange formed between the stretching rolls and freely rotating rolls for end-forming the rim flange. The invention provides, in particular, the possibility of rapid, accurate and optimum formation of the inner rim flange of a light metal wheel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
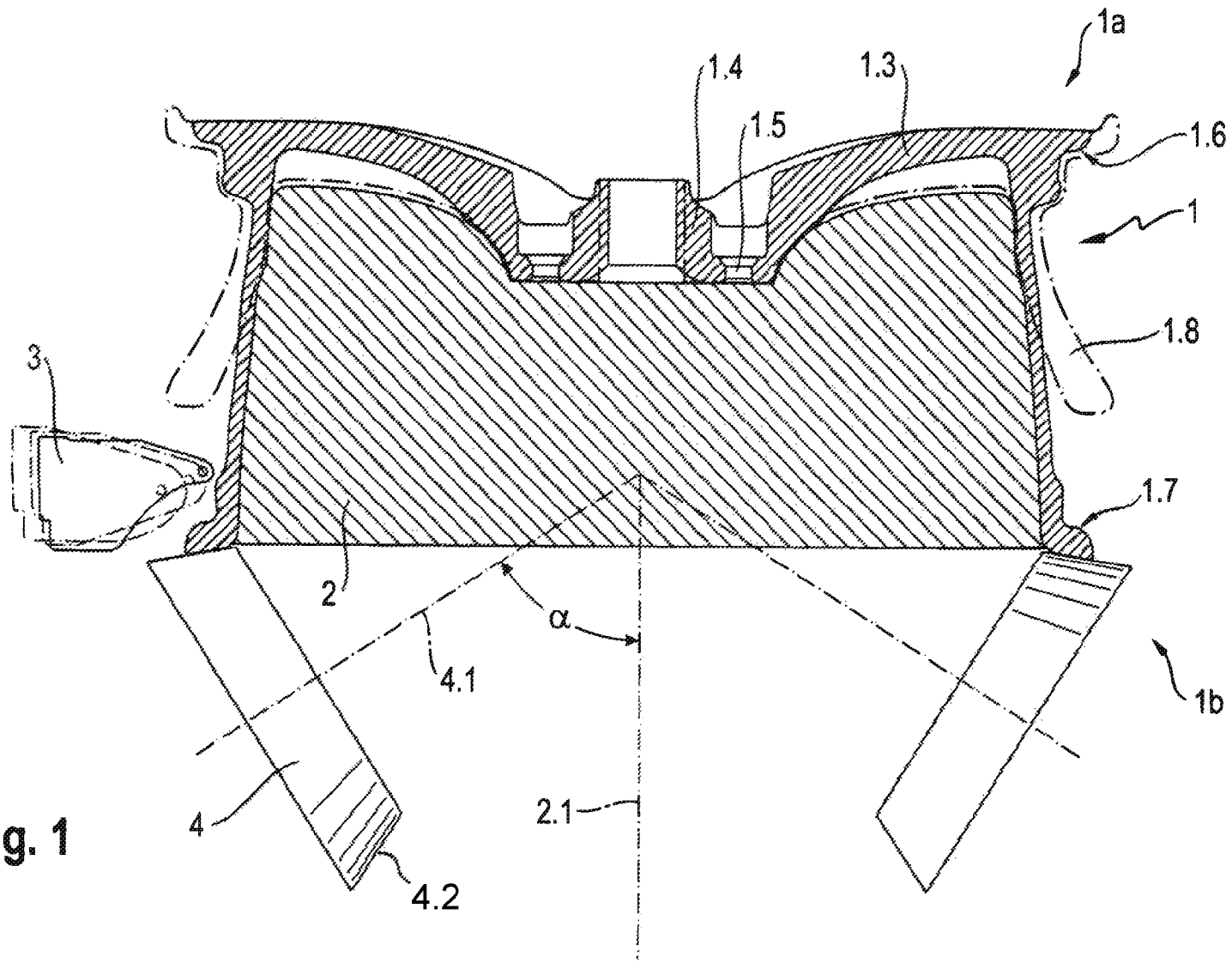
FIG. 1 is a side view of essential parts of a device according to the invention for manufacturing a light metal wheel—without a profile stretching roll.
Figure 2:
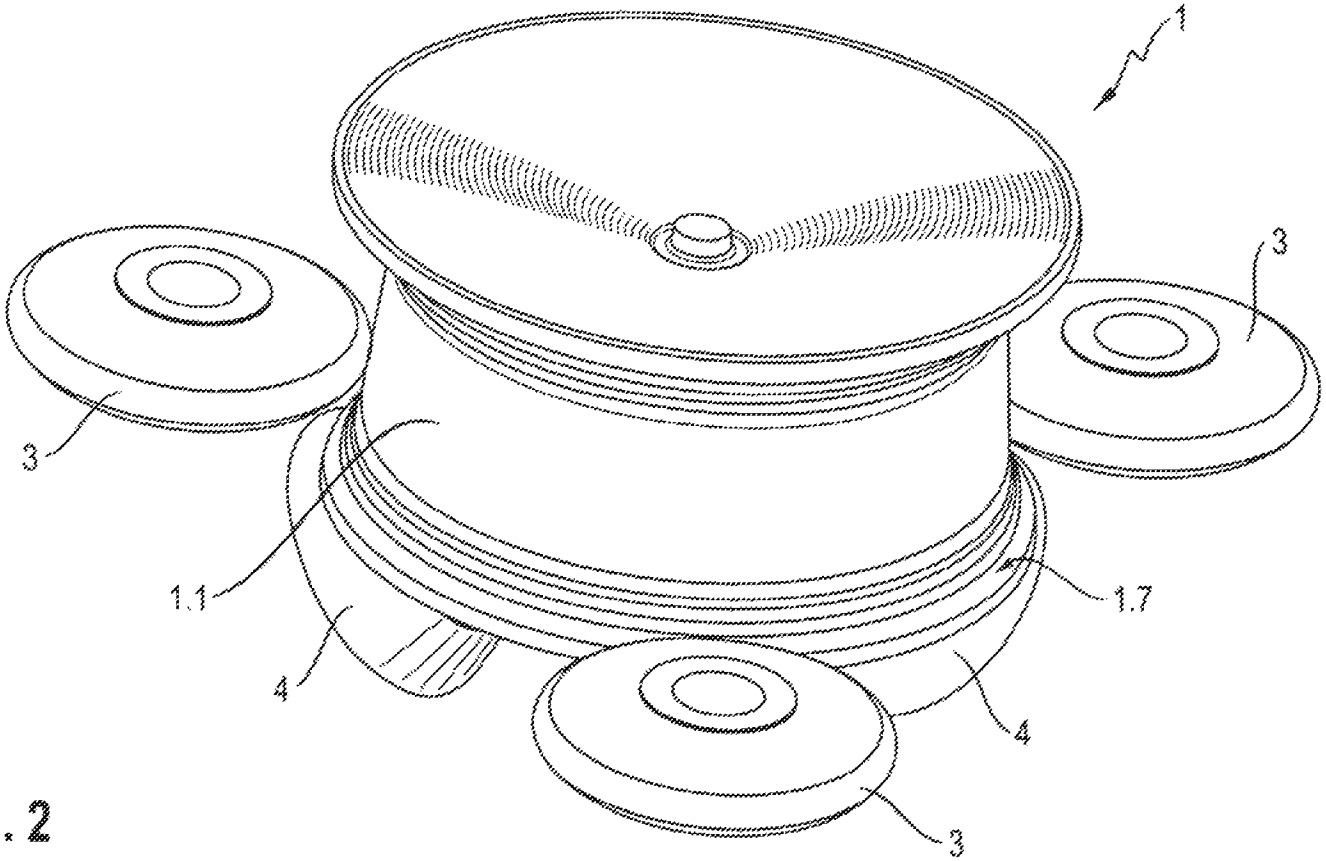
FIG. 2 is a perspective oblique elevation view of a wheel and essential parts of the device according to the invention (profile stretching rolls not visible)
Figure 4:
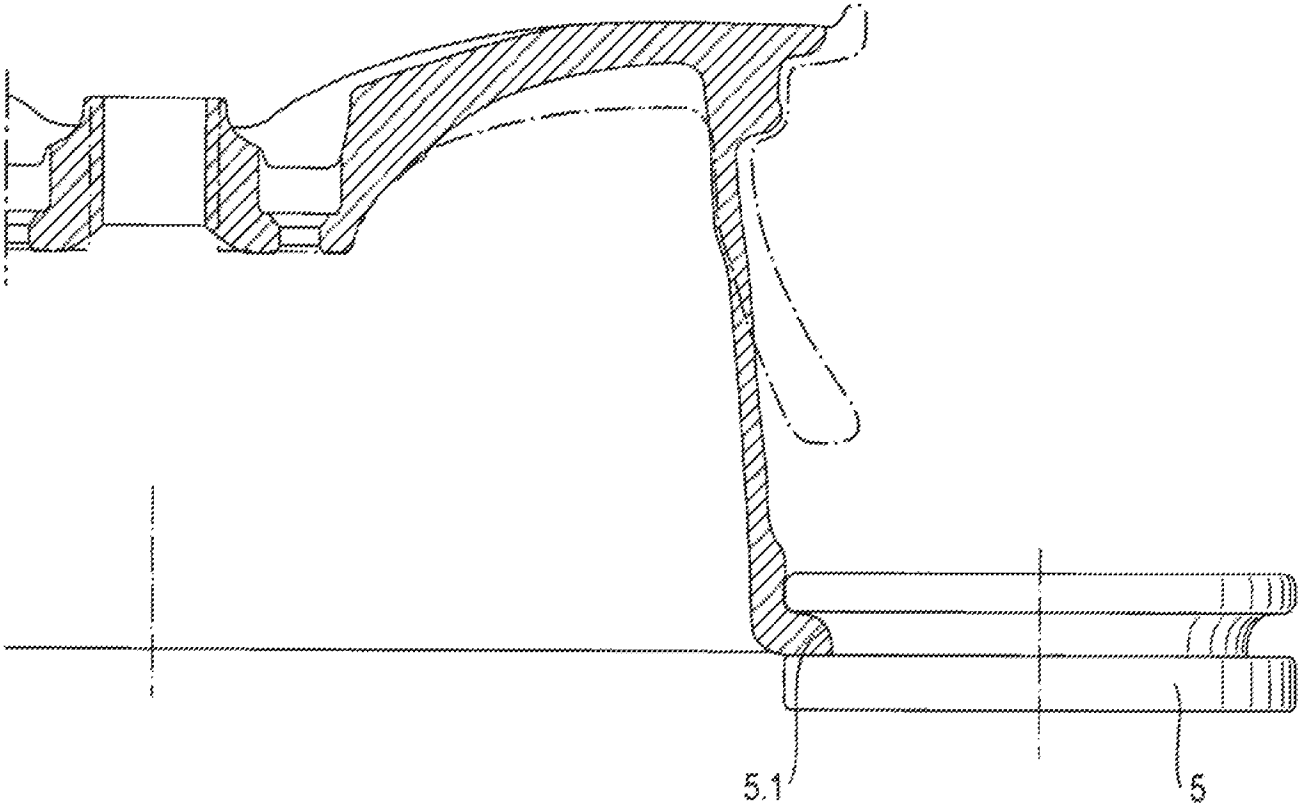
FIG. 4 is a partial view, according to FIG. 1, with a profile stretching roll engaging on the lower or inner rim flange.

Referring to the drawings in particular, FIGS. 1 and 4 show a motor vehicle metal wheel 1, as a dotted line, as a pre-form and drawn with its final contour in sectional representation (only as a partial representation in FIG. 4). Wheel 1 has a rim 1.1 and at its outer side 1*a* a wheel disc or a spoke region 1.3 with a hub 1.4. Openings 1.5 are provided in the inner region of the wheel disc 1.3 outside hub 1.4 for fixing the wheel to the vehicle by means of bolts. Rim 1.1 has an outer rim flange 1.6 close to wheel disc 1.3 and an inner rim flange 1.7 at its inner side 1*b*, facing away from wheel disc 1.3.

Whereas the outer region of the pre-form 1.8, particularly the wheel disc or spoke region 1.3 are already identical or at least very much approached to the final shape of the wheel the circumferential wall of the pre-form 1.8, particularly at its inner region (shown below in the drawings) extends substantially radially beyond the final contour of the wheel. Also the circumferential wall of the pre-form 1.8 extends only along a part, particularly along 50% to the 70% of the height of the final wheel.

Figure 3:
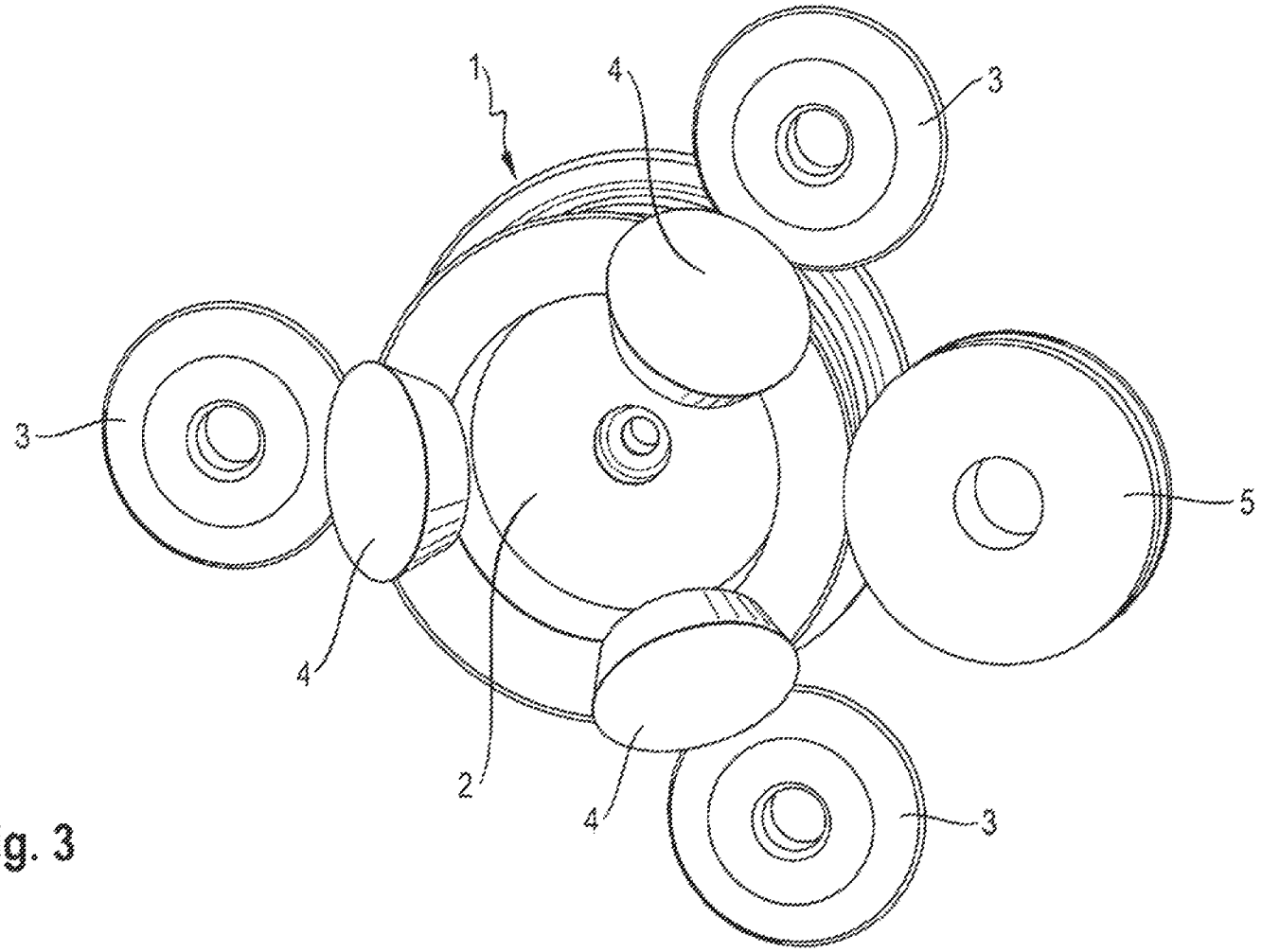
FIG. 3 is a perspective view from below of the essential features of the device according to the invention.

FIGS. 1 to 4 also show the essential tool elements of the device according to the invention for manufacturing such a metal wheel, particularly a light metal wheel, from the pre-form, namely a simple tool 2 engaging in the pre-form or the wheel, in the form of a clamping mandrel, a plurality of differently designed stretching rolls 3 engaging on the peripheral wall of the pre-form or wheel, freely rotating rolls 4 gripping the lower edge of the inner and inner rim edge 1.7 of the almost completed wheel 1 from below, and at least one profile stretching roll 5 (FIGS. 3, 4). Only the half of stretching rolls 3 directed toward wheel 1 is shown. Stretching walls 3 are rotatable about an essentially vertically extending axis of rotation.

The pre-form of wheel 1 sits on a simple tool in the form of a clamping mandrel 2 designed as a rotary body, which mandrel determines the inner shape of wheel 1. The clamping mandrel 2 is in one piece. In the peripheral area it does not have any undercuts and increases slightly conically in diameter from the outside 1*a* of the wheel 1 to the inside 1*b*, so that the formed wheel can be easily removed from the clamping mandrel 2.

Stretching rolls 3 engage on the outer periphery of wheel 1, distributed uniformly, in particular, over the circumference, which rolls, as shown in the left-side superimposed representation in FIG. 1, may be of different designs. They initially engage an axially outer side of the pre-form of wheel 1 and in doing so stretch downwards and at the same time compress part 1.8 of the pre-form of the wheel forming the subsequent wheel jacket or the actual rim 1.1 of wheel 1.

The pre-form of wheel 1 or wheel 1 are supported on one side by clamping mandrel 2. However, this mandrel does not grip from underneath the edge, the subsequent inner rim flange 1.7 of the wheel. This edge is instead gripped from below by additional freely rotating rolls 4. Three rolls are preferably arranged so that they are evenly distributed over the circumference, each underneath a stretching roll 3.

In addition, as shown in FIG. 3 and particularly in FIG. 4, at least one profile stretching roll 5 is provided laterally in the region of the inner rim flange 1.7 to be formed, circumferentially between two freely rotating rolls 4, which roll end-forms the profile of the inner rim flange 1.7, by the radial exertion of pressure in its profile groove 5.1 provided on the circumference. As shown in FIG. 1, the freely rotating rolls 4 are aligned with its axis of rotation 4.1 to axis of rotation 2.1 of clamping mandrel 2, and hence of wheel 1 mounted on the mandrel in a fixed position at an angle $\alpha$ of approximately 60°. The freely rotating rolls 4 are designed in the shape of a truncated cone and are reduced from their lower to their upper side, wherein jacket wall 4.2 forms an angle from 20 to 30° to axis of rotation 4.1. The freely rotating rolls 4 engage with their jacket wall against the inner-lower side of wheel 1 to form the inner rim flange 1.7. The axis of rotation of the freely rotating rolls 4.1 is to a certain extent freely adjustable, for example between 50 and 70° relative to axis of rotation 2.1 of clamping mandrel 2, so that the inner front side of the inner flange rim 1.7 can therefore be adjusted by the angle of attack of axis of rotation 4.1.

The manufacturing process is essentially as follows:

The pre-form of wheel 1 is first cast and freed from connecting ports. The pre-form is then clamped onto clamping mandrel 2 and can be heated, ideally not above 350° C. Stretching rolls 3 are then displaced in an axially outer side of the pre-form against the same and move, with the exertion of radial pressure, from the outer rim flange 1.6 down to the inner rim flange 1.7, thereby forming rim 1.1 and essentially rim flanges 1.6, 1.7. Here the material of the jacket of the wheel is on the one hand drawn, i.e. stretched, downwards into the region of the inner rim flange 1.7 to form the rim, and on the other the material of the wheel is compressed. As soon as the jacket material of the wheel has been stretched by stretching rolls 3 below the lower edge of clamping mandrel 2, the freely rotating rolls 4 engage at that point with their jacket wall 4.2, whilst profile stretching roll 5 engages in the interval between two freely rotating rolls 4, exerts radial pressure and forms and end-forms the inner rim flange 1.7 in its profile groove 5.1.

While specific embodiments of the invention have been shown and described in detail to illustrate the application of the principles of the invention, it will be understood that the invention may be embodied otherwise without departing from such principles.

The invention claimed is:

1. A device for manufacturing a metal wheel from a pre-form, the device comprising:

stretching rolls engaging a rim region at a radially outer side of the pre-form, and said stretching rolls being displaceable radially against said outer side of the pre-form in an axially outer region of said pre-form and said stretching rolls being movable on said radially outer side of the pre-form axially along a circumferential wall of the pre-form for radial compression and axial stretching of the circumferential wall of the pre-form, wherein said stretching rolls form a rim of the metal wheel, the pre-form being rotationally symmetrical, said circumferential wall of the pre-form extending axially only along a part of the metal wheel after finishing the metal wheel, said circumferential wall having an axial inner region, said axial inner region extending radially beyond a final contour of the metal wheel after finishing the metal wheel, said stretching rolls exerting a radial force on said circumferential wall and radially compressing said circumferential wall, wherein an end of the metal wheel is formed via at least said stretching rolls stretching said circumferential wall; and freely rotating rolls for creating an inner rim flange, said freely rotating rolls being arranged underneath the stretching rolls, wherein a jacket wall of the freely rotating rolls provide abutments from underneath for the pre-form and the stretching rolls cooperate with the freely rotating rolls for forming the inner rim flange by stretching of pre-form material against the freely rotating rolls, said freely rotating rolls being arranged under an axially inner end of the pre-form.

2. A device according to claim 1, wherein the freely rotating rolls have an axis of rotation inclined at an angle of inclination from 50° to 70° to an axis of rotation of the pre-form.

3. A device according to claim 2, wherein the angle of inclination of the axes of rotation of the freely rotating rolls is adjustable to the axis of rotation of the pre-form.

4. A device according to claim 1, wherein the freely rotating rolls grip the inner rim flange to be formed from below with said jacket wall thereof.

5. A device according to claim 1, wherein the freely rotating rolls are designed in a shape of a truncated cone.

6. A device according to claim 5, wherein the jacket wall of the freely rotating rolls form an angle between 20° and 40° to an axis of rotation of the freely rotating rolls.

7. A device according to claim 1, further comprising:

at least one profile stretching roll end forms the inner rim flange.

8. A device according to claim 1, wherein said freely rotating rolls provide said abutments at a height of the inner rim flange to be created.

9. A method for manufacturing a metal wheel from a pre-form, wherein the pre-form of the metal wheel to be manufactured is placed on a clamping mandrel and caused to rotate, the method comprising:

providing stretching rolls, said stretching rolls engaging a radially outer side at an axially outer region of a circumferential wall of the pre-form;

moving said stretching rolls axially along said radially outer side of the pre-form such that the circumferential wall is radially compressed and axially stretched from a non-stretched state to a stretched state to form a rim of the metal wheel, said circumferential wall being rotationally symmetrical, said circumferential wall of the pre-form extending axially only along a part of the metal wheel after finishing the metal wheel, wherein an end of said rim is formed via at least said stretching rolls stretching said circumferential wall, said circumferential wall having an axial inner region, said axial inner region extending radially beyond a final contour of the metal wheel after finishing the metal wheel; and gripping the pre-form from below by jacket walls of freely rotating rolls which are arranged at the same circumferential angles as circumferential angles of the stretching rolls around a periphery of the pre-form and the stretching rolls in cooperation with the freely rotating rolls form a rim flange by the stretching rolls stretching pre-form material against the freely rotating rolls gripping the pre-form from below, said freely rotating rolls being arranged under an axially inner end of the pre-form.

10. A method according to claim 9, wherein the freely rotating rolls rotate about axes which form an angle of inclination of 50° to 70° to the axis of rotation of the pre-form.

11. A method according to claim 9, wherein the freely rotating rolls grip a lower edge of the pre-form from below with said jacket walls, which forms an angle of 20° to 40° to the axis of rotation of the freely rotating rolls.

12. A method according to claim 9, wherein at least one profile stretching roll engages on the rim flange formed between said stretching rolls and said freely rotating rolls exerts a radial pressure and end-forms the rim flange.

13. A device for manufacturing a metal wheel from a pre-form, the device comprising:

a plurality of stretching rolls, each of said stretching rolls being arranged at a radially spaced location from an interior space of the pre-form, each of said stretching rolls comprising a rim region contact surface for engaging a rim region of the pre-form, said rim region comprising a radially outer side, each of said stretching rolls being mounted for movement such that each of said plurality of stretching rolls engages at least a portion of said radially outer side and each of said plurality of stretching rolls moves in an axial direction with respect to a longitudinal axis of a respective one of said stretching rolls with said region contact surface in contact with said at least said portion of said radially outer side to stretch the pre-form from a non-stretched state to a stretched state; and a plurality of freely rotating rolls for creating an inner rim flange, said freely rotating rolls being arranged at a position below a position of the stretching rolls, each of said freely rotating rolls comprising a pre-form contact surface for contacting the pre-form, the stretching rolls cooperating with the freely rotating rolls for forming the inner rim flange by stretching of pre-form material against the freely rotating rolls.

14. A device according to claim 13, wherein each of said stretching rolls move radially and axially along a circumferential wall of the pre-form for radial compression and axial stretching of the circumferential wall of the pre-form, wherein said stretching rolls form a rim of the wheel, each of said stretching rolls being located at a position outside of the interior space of the pre-form, said circumferential wall comprising a non-stretched axial extent in said non-stretched state, said circumferential wall comprising a stretched axial extent in said stretched state, said non-stretched axial extent having a length that is less than a length of said stretched axial extent, said circumferential wall comprising a non-stretched inner region in said non-stretched state, said circumferential wall comprising a stretched inner region in said stretched state, wherein said non-stretched inner region extends radially beyond said stretched inner region, said circumferential wall of the pre-form being rotationally symmetrical, wherein an end of the wheel is formed via at least said stretching rolls stretching said circumferential wall of the pre-form, said freely rotating rolls being arranged at a position below an axially inner end of the pre-form.

15. A device according to claim 13, wherein the freely rotating rolls have an axis of rotation inclined at an angle of inclination from 50° to 70° to an axis of rotation of the pre-form.

16. A device according to claim 15, wherein the angle of inclination of the axes of rotation of the freely rotating rolls is adjustable to the axis of rotation of the pre-form.

17. A device according to claim 13, wherein the pre-form contact surface grips the inner rim flange to be formed from said position below said position of the stretching rolls.

18. A device according to claim 13, wherein each of the freely rotating rolls comprises a truncated cone.

19. A device according to claim 18, wherein said pre-form contact surface of each of the freely rotating rolls form an angle between 20° and 40° to an axis of rotation of the freely rotating rolls.

20. A device according to claim 13, further comprising:

at least one profile stretching roll forms the inner rim flange, said at least one profile stretching roll being arranged between one of said stretching rolls and another one of said stretching rolls with respect to a circumferential direction of the pre-form.

* * * * *